US005970516A

United States Patent [19]

Shimooka

[11] Patent Number: 5,970,516

[45] Date of Patent: Oct. 26, 1999

[54] ARTICLE OF CLOTHING FOR MAKING A PATTERNED SUNBURN

[76] Inventor: Nobuyuki Shimooka, 2-170-702, Nagatanaka, Higashiosaka, Osaka 577, Japan

[21] Appl. No.: 09/024,515

[22] Filed: Feb. 17, 1998

[51] Int. Cl.[6] ..... A41B 1/00

[52] U.S. Cl. ..... 2/69; 2/67; 2/227; 2/238; 2/311; 2/338

[58] Field of Search ..... 2/67, 69, 227, 2/228, 338, 238, 311–312, 1, 115

[56] References Cited

U.S. PATENT DOCUMENTS

| | | | |
|---|---|---|---|
| 2,079,980 | 5/1937 | Anders | 2/115 |
| 3,828,368 | 8/1974 | Lam | 2/227 |
| 4,501,024 | 2/1985 | Russo | 2/67 |
| 4,546,493 | 10/1985 | Bortnick | 2/67 |
| 4,813,081 | 3/1989 | Cliff et al. | 2/115 |
| 5,515,542 | 5/1996 | Simmons | 2/67 |

FOREIGN PATENT DOCUMENTS

| | | | |
|---|---|---|---|
| 2219187 | 12/1989 | United Kingdom | 2/338 |

*Primary Examiner*—Gloria Hale
*Attorney, Agent, or Firm*—Wenderoth, Lind & Ponack, L.L.P.

[57] ABSTRACT

An article of clothing having a light blocking pattern or a light transmitting pattern. The clothing article may also have a removable light blocking pattern or a removable light transmitting pattern. By wearing the article of clothing a person is provided with a patterned suntan or sunburn. The patterned sunburn may be attractive to the wear's intimate friends when the wearer is in a state of undress. The patterned sunburn may also be entertaining to oneself when looking (her or his) in a mirror. Also, a sharp patterned sunburn, similar to a tattoo, can be formed on the wear's skin.

10 Claims, 3 Drawing Sheets

ARTICLE OF CLOTHING FOR MAKING A PATTERNED SUNBURN

BACKGROUND OF THE INVENTION

1. Technical Field

This invention relates to clothing for making a patterned sunburn or suntan in a person's skin.

2. Description of Related Art

Prior swim clothing to be worn in the sunlight provides the wearer's exposed skin with an overall sunburn. The sunburn pattern is equal to the shape of the swim clothing. Thus, the sunburn pattern is not attractive to one's intimate friends.

It is an object of the present invention to provide clothing which will provide the wearer with an attractive or amusing patterned sunburn. The patterned sunburn may be attractive to the wearer's intimate friends when the person is undressed. The patterned sunburn may also entertain oneself when the wearer looks at their (her or his) nude body in a mirror.

It is another object of the present invention to provide a sharp patterned sunburn like a tattoo on a person's skin.

SUMMARY OF THE INVENTION

In a first aspect, the present invention includes having a light blocking pattern or a light passing or transmitting pattern.

In another aspect the present invention includes clothing having a removable light blocking pattern or a removable light passing or transmitting pattern.

The present invention thus has all of the advantages of providing a person's skin with a sharp patterned sunburn.

BRIEF DESCRIPTION OF THE DRAWINGS

The invention is further described with reference to the accompanying drawings in which.

DETAILED DESCRIPTION OF THE PRESENT INVENTION

The stated object, other characteristics and the present invention itself will be well understood following the description of the embodiments of the present invention in conjunction with the accompanying drawings.

Figure 1:
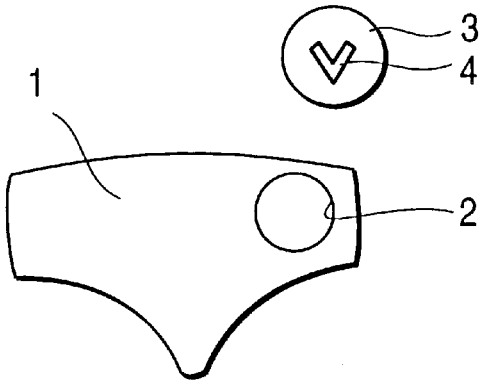
FIG. 1 is a front view of an article of clothing, with a part thereof separated according to the present invention.
Figure 2:
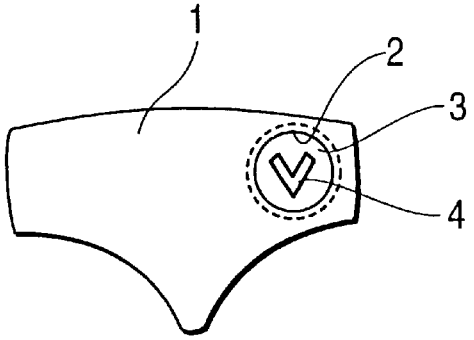
FIG. 2 is a front view of the article of clothing shown in FIG. 1, with the part thereof not separated.

In FIG. 1 an article clothing 1 according to the present invention is a swimsuit and has an opening 2. At the edge of the opening 2 is a light blocking plate 3 which is to be attached to the swimsuit as shown in FIG. 2. The plate 3 has a cut-out pattern 4. The illustrated pattern 4 is formed by cutting an opening in the shape of a "V" in the plate 3.

Figure 4:
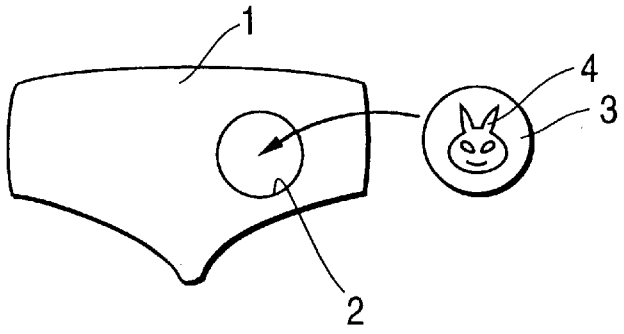
FIG. 4 is a front view of another article of clothing, with a part thereof separated according to the present invention.

The light blocking plate 3 is formed of a soft material such as synthetic resin, rubber, or foamed synthetic resin. The light blocking plate 3 can be replaced by a light passing or transmitting plate. The light transmitting plate is made of a soft material such as a transparent vinyl resin, and a transparent polypropylene resin. The pattern 4 illustrated in FIG. 4 is a light blocking pattern 4 such as an inked printing provided on the light transmitting plate 3.

Figure 3:
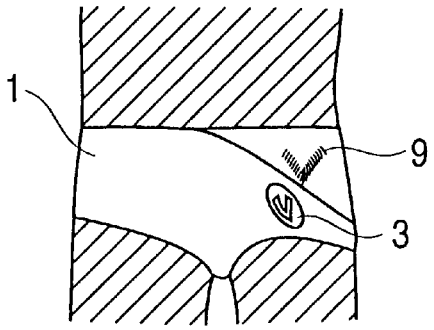
FIG. 3 is a front view of the article of clothing in use and a patterned sunburn made by use of the clothing.
Figure 5:
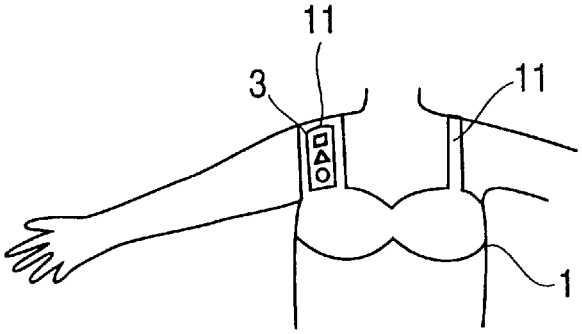
FIG. 5 is a front view of another article of clothing in use according to the present invention.
Figure 6:
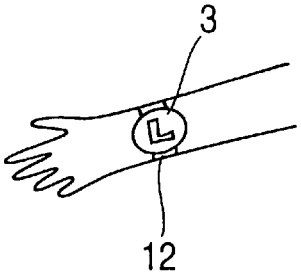
FIG. 6 is a perspective view of another article of clothing in use according to the present invention.

The light blocking plate 3 is attached to the article of clothing for example by sewing, or heat melting resin. The patterned sunburn 9 formed by use of the light blocking plate 3 of FIG. 2, is shown in FIG. 3. The light blocking plate 3 can be provided in a shoulder strap 11 as shown in FIG. 5. The light blocking plate 3 can also be provided on a transparent wrist band 12 as shown in FIG. 6.

Figure 7:
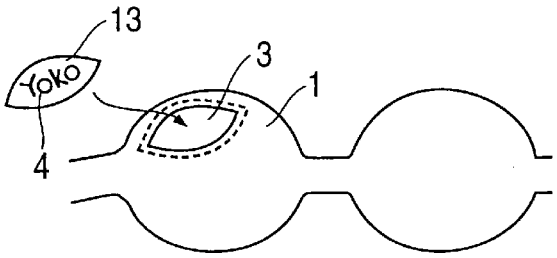
FIG. 7 is a front view of another article of clothing, with a part thereof separated according to the present invention.
Figure 8:
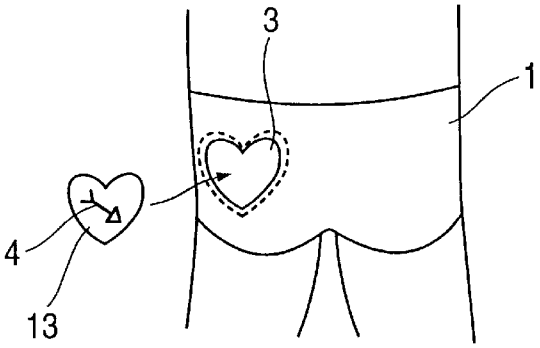
FIG. 8 is a front view of another article of clothing, with a part thereof separated according to the present invention.

Both of FIGS. 7 and 8 show a different embodiment of the clothing article 1, in which a light passing plate 3 is provided in a swimwear top. A printed pattern 4 is provided on a transparent adhesive sticker 13. The sticker 13 is placed on the light passing or transmitting plate 3.

Figure 9:
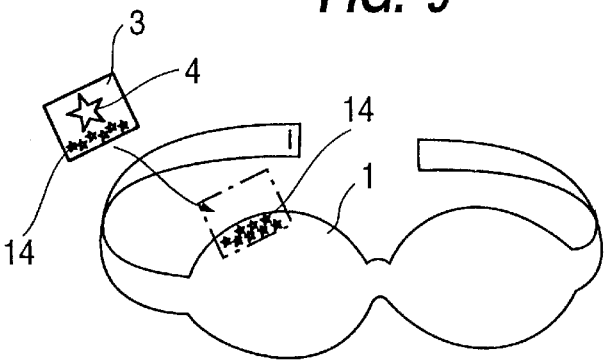
FIG. 9 is a perspective view of another article of clothing, with a part thereof separated according to the present invention.

FIG. 9 shows a different embodiment of the clothing article 1, which includes a loop and hook fastener 14. The light passing or transmitting plate 3 includes a light blocking pattern 4 and a loop and hook fastener 14. The fastener 14 of the plate 3 can be attached to the fastener 14 of the clothing article 1. Thus, the plate 3 can be removably attached to the clothing article 1.

I claim:

1. An article of clothing for making a patterned sunburn, said article of clothing comprising a section of material defining an opening for exposing a wear's skin, and a plate removably attached in said opening of said section of material, wherein said plate is formed so that light is transmittable through said plate in a desired pattern in order to form the desired pattern on a wear's skin.

2. An article of clothing as claimed in claim 1, wherein said article of clothing is a swimsuit.

3. An article of clothing as claimed in claim 1, wherein said plate is formed of a light-blocking material, and includes an aperture having a shape corresponding to the desired pattern.

4. An article of clothing as claimed in claim 1, wherein said plate is formed of a material which will permit the transmission of light and includes a light-blocking pattern which is printed on an outer surface of said plate.

5. An article of clothing as claimed in claim 1, wherein said plate is sewn to said section of material at said opening.

6. An article of clothing as claimed in claim 1, wherein said plate is adhesively connected to said section of material at said opening.

7. A clothing article comprising:

a transparent strap-like member; and a plate removably attached to said transparent strap-like member, wherein said plate is formed so that light is transmittable through said plate in a desired pattern so that, when the clothing article is worn on a body, skin of the body is exposed to rays of light in order to tan the exposed skin in a shape of the desired pattern.

8. A clothing article as claimed in claim 7, wherein the clothing article is a wrist band.

9. A clothing article as claimed in claim 7, wherein said plate is formed of a light-blocking material, and includes an aperture having a shape corresponding to the desired pattern.

10. An article of clothing as claimed in claim 7, wherein said plate is formed of a material which will permit the transmission of light and includes a light-blocking pattern which is printed on an outer surface of said plate.

* * * * *